US010807742B2

(12) United States Patent
Nienberg

(10) Patent No.: US 10,807,742 B2
(45) Date of Patent: Oct. 20, 2020

(54) SYSTEMS AND ASSEMBLIES FOR FILLING AND COILING BARRIER TUBES AND ASSOCIATED METHODS

(71) Applicant: Ulterior Products, LLC, Hillard, OH (US)

(72) Inventor: Kurt Nienberg, Hillard, OH (US)

( * ) Notice: Subject to any disclaimer, the term of this patent is extended or adjusted under 35 U.S.C. 154(b) by 118 days.

(21) Appl. No.: 15/697,555

(22) Filed: Sep. 7, 2017

(65) Prior Publication Data

US 2018/0065763 A1 Mar. 8, 2018

Related U.S. Application Data

(60) Provisional application No. 62/384,581, filed on Sep. 7, 2016.

(51) Int. Cl.
*B65B 1/12* (2006.01)
*E02D 29/02* (2006.01)
*E02B 3/12* (2006.01)

(52) U.S. Cl.
CPC ..... *B65B 1/12* (2013.01); *E02D 29/0291* (2013.01); *E02B 3/127* (2013.01)

(58) Field of Classification Search
None
See application file for complete search history.

(56) References Cited

U.S. PATENT DOCUMENTS 7,452,165 B2 11/2008 Tyler
7,654,292 B2 2/2010 Sweningson
2009/0308486 A1* 12/2009 Ours ..... B65B 11/045 141/10

* cited by examiner

*Primary Examiner* — Daphne M Barry
(74) *Attorney, Agent, or Firm* — Brannon Sowers & Cracraft PC

(57) ABSTRACT

A vertically oriented barrier filling assembly for filling barrier tubing with a filling material and coiling filled barriers is disclosed. The barrier filling assembly includes a barrier filling device positioned above a barrier receiving device. The barrier filling device includes a coiler hopper that funnels the filling material to a barrel. An auger situated in the barrel includes a shaft and a fighting, with rotation of the auger feeding the filling material to empty barrier tubing attached to the barrel. Filled barriers are coiled on a vertically adjustable floor of the barrier receiving device as the barrier tubing is filled by moving the coiler hopper and/or the barrel in an orbital path. A system for filling and coiling barriers includes a supply hopper, the assembly, a processing station, and one or more conveyors, the system having a process flow from the storage hopper to the assembly to the processing station.

17 Claims, 4 Drawing Sheets

SYSTEMS AND ASSEMBLIES FOR FILLING AND COILING BARRIER TUBES AND ASSOCIATED METHODS

TECHNICAL FIELD

The present disclosure relates generally to filling barrier tubes, and, in certain aspects, the ability to fill such tubes while coiling them on a surface or an object via a movable filling assembly.

BACKGROUND

Construction projects and the like typically present numerous logistical concerns, particularly when the project involves a public area or utility, for example, construction of a highway. Such projects frequently implicate and possibly interrupt or alter the normal drainage of surface water, which may raise concerns relating to erosion control and wastewater management, for instance. Accordingly, industry standards have developed and various levels of government have adopted regulations to address environmental consequences of these projects.

Those of skill in the art will be familiar with the wide variety of technologies developed to address these and other concerns. In the area of erosion control, U.S. Pat. No. 7,452,165 to Tyler for a Containment Systems, Methods, and Devices ("Tyler") is one example of such advancement. Tyler teaches systems, methods and devices for erosion control generally relating to a tubular mesh enclosure containing a filler material, the combination of which contains some water while allowing some amounts to pass through the device. Subsequent technologies have been developed to employ this strategy as the barriers are difficult to construct and transport. One such development is known from U.S. Pat. No. 7,654,292 to Sweningson for an Erosion Control Device, which teaches a method and apparatus for filling barrier tubes.

Despite advances in the art, difficulties in employing these advances in a practical sense remain. For example, such barriers are difficult to construct, as the mesh material used to contain filler material can buckle or stretch if filled improperly or at an improper rate. Further, in order to transport filled barriers, the barriers are generally coiled on a pallet or other structure for easy deployment at the construction site. Coiling involves further risks to the integrity of the outer barrier material, however, and must be done manually, which can be inefficient.

SUMMARY OF THE INVENTION

In one aspect, a barrier tube filling assembly includes a suspension element, a coiling surface having a vertical axis, and a material conduit that has a feeder section at a dispensing end of the material conduit, the material conduit being coupled with the suspension element such that the feeder section is suspended above the coiling surface in a substantially vertical orientation, and the dispensing end being movable in an orbital path relative to the vertical axis.

In another aspect, a system for filling and packaging barrier tubes is disclosed includes a storage hopper, a vertically oriented barrier tube filling assembly structured to fill barrier tubes with a filler material and coil filled barriers, a material conveyor coupling the supply hopper to the barrier tube filling assembly, and a processing station structured to receive a coiled barrier.

In still another aspect, a method for coiling barriers includes attaching empty barrier tubing to a material conduit, moving the material conduit in a coiling pattern at a rate substantially identical to a feed rate, and sealing an open end of the barrier tubing.

DETAILED DESCRIPTION

Figure 1:
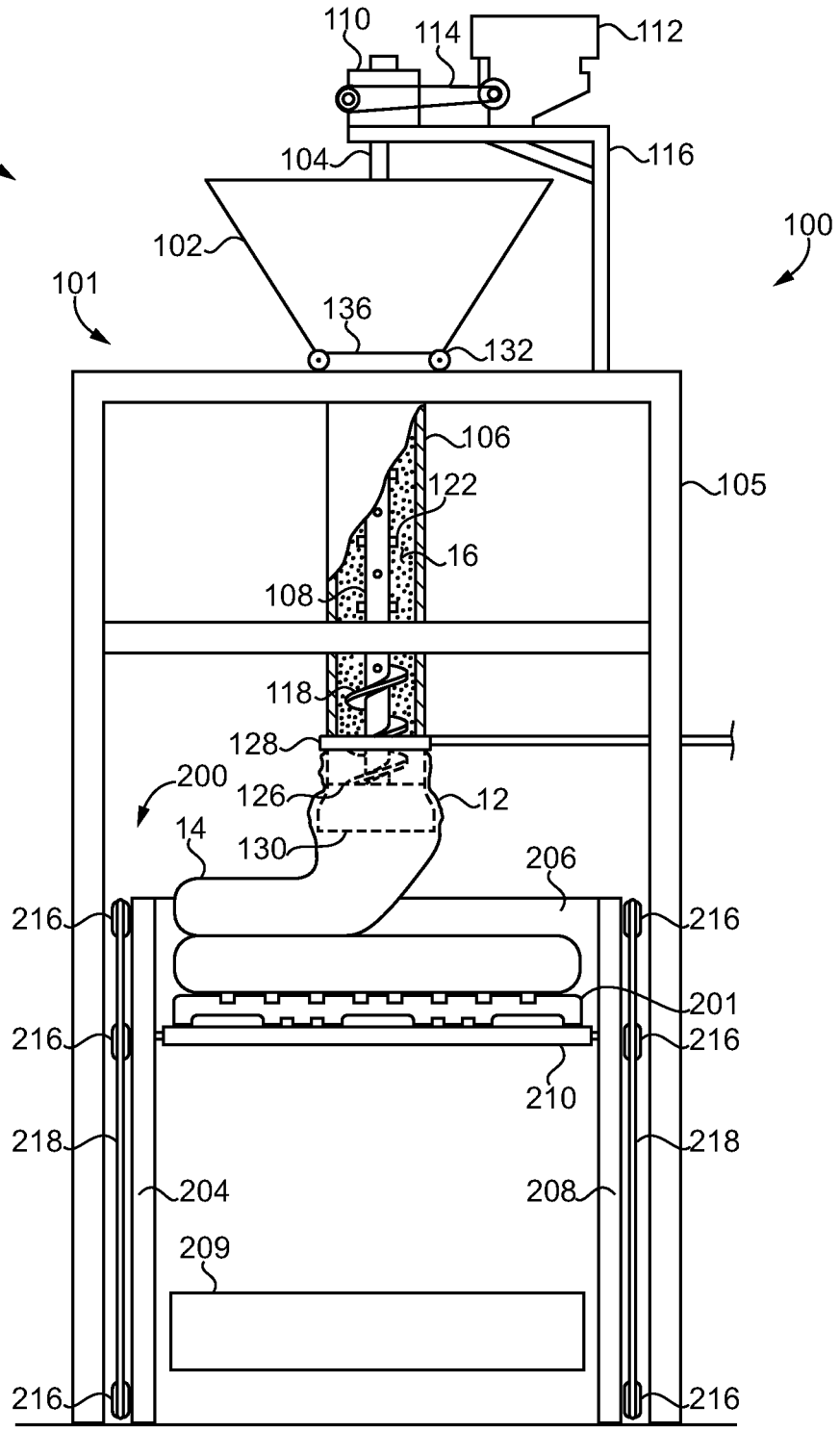
FIG. 1 is a partially sectioned diagrammatic view of a vertically oriented barrier filling assembly, according to one embodiment.

Referring to FIG. 1 there is shown a vertically oriented barrier filling assembly (hereinafter "assembly") 10 for filling empty barrier tubing (hereinafter "tubing") 12, according to one embodiment. Filled barrier tubing 14 includes a barrier (hereinafter "barrier 14"), such as a construction barrier. Use of the term "construction" herein is intended in an illustrative sense only, as the teachings of the present disclosure could be applied where no active building, digging, paving, or other acts commonly understood as construction practices are taking place. Tubing 12 generally includes a flexible mesh-based material constructed in a hollow, tube-like configuration as would be understood by those with skill in the art. Assembly 10 may include a barrier filling device (hereinafter "filling device") 100 and a barrier receiving device (hereinafter "receiving device") 200, with filling device 100 positioned above receiving device 200. Filling device 100 and receiving device 200 may be separate structures, although embodiments in which filling device 100 and receiving device 200 are integrated into a single structure are also contemplated.

Figure 2:
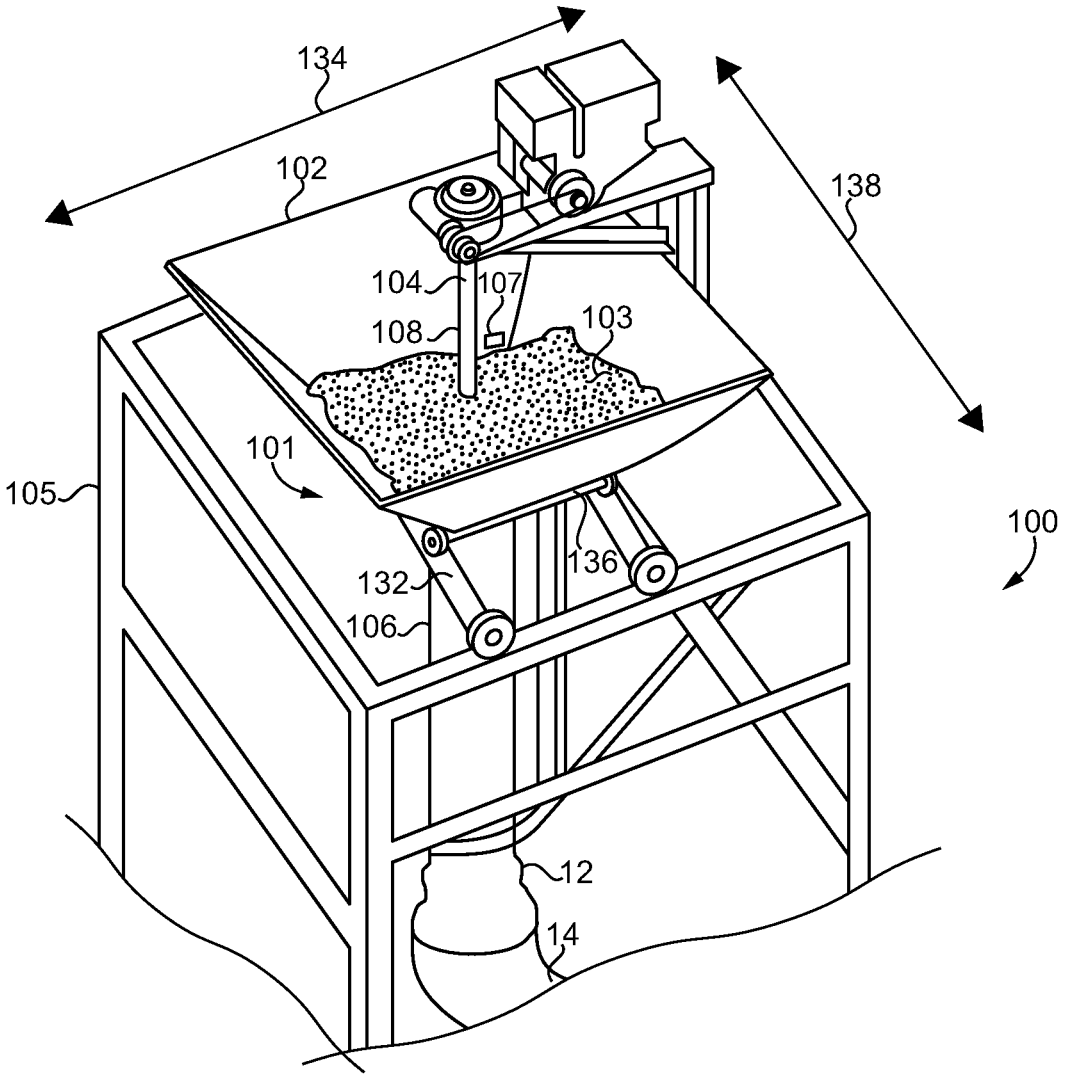
FIG. 2 is a diagrammatic view of a barrier filling device, according to one embodiment.
Figure 4:
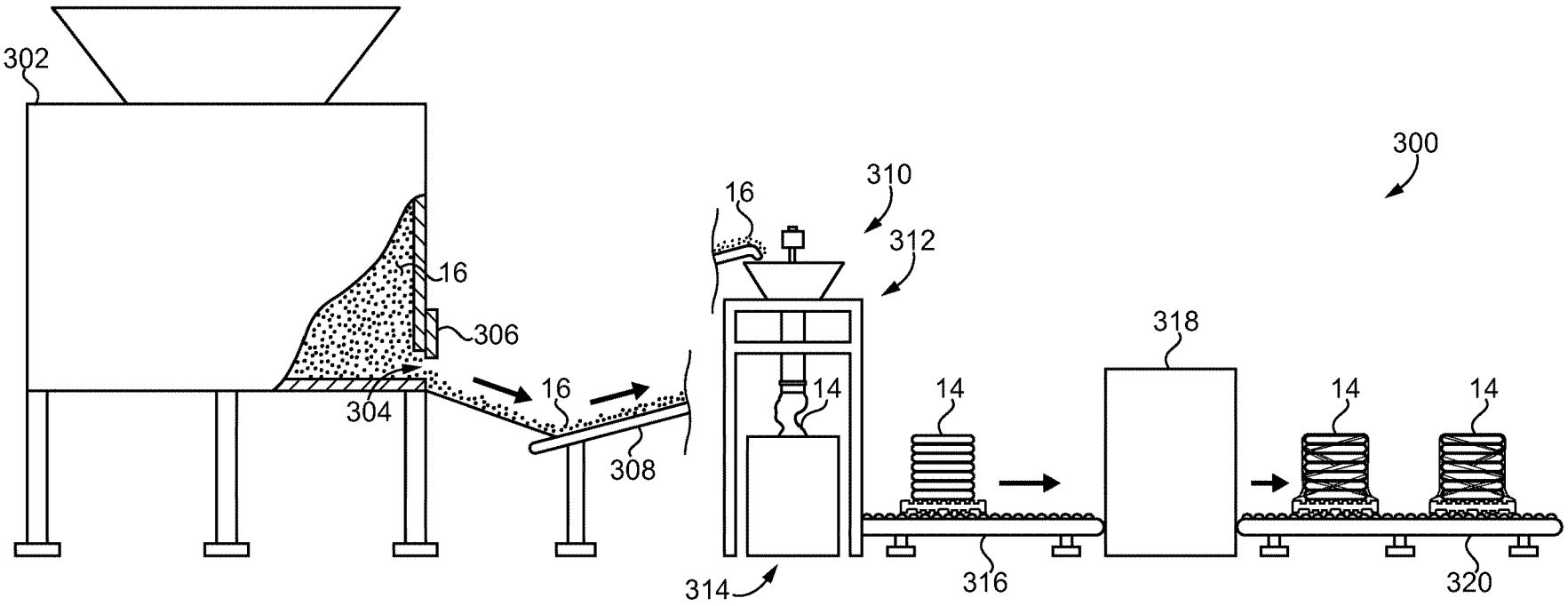
FIG. 4 is a partially sectioned diagrammatic view of a system for filling and coiling barrier tubing, according to one embodiment.

Referring now also to FIG. 2, a partially sectioned diagrammatic view of filling device 100 is shown. Filling device 100 may include a material conduit 101 structured to facilitate flow of a filler material 16 to tubing 12. Material conduit 101 may include a receiving section 102, which includes a coiler hopper (hereinafter "hopper 102"). A suspension element 105, which includes a gantry (hereinafter "gantry 105"), may support and/or suspend material conduit 101. Filler material 16 might be compost, straw, soil, mixtures of these, or still another material. A material conveyor, such as a sling or belt conveyor (as illustrated in FIG. 4, discussed hereinafter), may deliver filler material 16 to hopper 102, which may then be funneled or otherwise conveyed to an auger 104 extending substantially downward into and through hopper 102 to a feeder section 106 of material conduit 101. Feeder section 106 includes a barrel (hereinafter "barrel 106"), which may be attached to and positioned below hopper 102. Hopper 102 may have a photelectric sensor 107 structured to detect the presence of filler material 16, or to detect when an amount of the filler material in hopper 102 falls below a predetermined threshold level. Sensor 107 may be communicatively coupled to a controller (not pictured) structured to generate an alert or warning should the amount of filler material 16 in hopper 102 fall below a threshold level. In some embodiments, the controller may be structured to generate a signal capable of causing more of the filler material to be delivered to the hopper as will be appreciated from the discussion herein. In still other embodiments, a different type of sensor may be used, the sensor may be configured to detect a different operating parameter, or the sensor may be positioned on another component of the assembly. For example, a weight sensor may be used to monitor the weight of an amount of the filler material in the hopper, or the sensor may be a flow meter positioned on the barrel to monitor a feed rate of the filler material to the tubing.

Auger has a substantially cylindrical shaft 108 that may be received and secured by a drivetrain 110 to drive rotation of auger 104 around an axis of rotation defined substantially by the shaft. Motor 112 may be structured to generate and/or convert electric or any other form of energy to mechanical energy by any suitable means and transmit that mechanical energy to drive train 110 via a belt 114 to rotate auger 104. The amount of mechanical energy generated by motor 112 may vary depending on the length, size, or other dimensions of the various components of assembly 10 (e.g., volume capacity of hopper 102, axial length of auger 104/shaft 108) as well as the density and/or composition of filler material 16 or any other relevant characteristics or properties of assembly 10 and/or filler material 16. Motor 122 must be capable of generating and translating mechanical energy sufficient to rotate auger 104 with enough torque and rotational speed to break up filler material 16 and deliver the filler material to tubing 12 at a suitable rate as may be determined by an operator. Motor 112 and/or drive train 110 may be suspended above hopper 102 by support arm 116, though other embodiments having a variety of alternative configurations are contemplated. In other embodiments, rotation of auger 104 may be accomplished by any other device, assembly, configuration, or mechanism, such as a direct shaft drive, or other strategy suitable for generating sufficient mechanical energy to rotate auger 104 in a manner consistent with the present disclosure.

Auger 104 includes shaft 108 and a fighting 118 (i.e., a helical blade) positioned below the shaft. Shaft 108 may include one or more beater bars 122 in a spaced configuration. Flighting 118 is positioned inside barrel 106 so as to allow auger 104 to rotate freely therein, with the barrel functioning to contain and guide a flow of filler material 16 from hopper 102 towards a dispensing end 126 of barrel 106. The generally vertical orientation of assembly 10 enables fighting 118 to be provided along less than a full length of auger 104, as gravity assists in feeding filler material 16 to tubing 12. Shaft 108 may comprise a majority of the axial length of auger 104. For example, flighting 118 may comprise about a quarter or less of the axial length of auger 104 and/or about a third or less of the axial length of barrel 106. Beater bars 122 are sized and spaced on shaft 108 for agitating and stirring filler material 16 and may function to break apart chunks of filler material 16 depending on the filler material's consistency and other properties such as moisture and/or cohesiveness. Those of skill in the art will appreciate the advantages of having fighting 118 only on a lower portion of the auger, while utilizing beater bars 122 above fighting 118. For example, it will be appreciated that due to decreased friction during feeding, shorter flightings may allow for a lower torque rate at the auger while allowing for a higher feed rate. Alternative embodiments may include fighting that extends farther up the auger, however, potentially extending from a lower portion all the way up to, possibly even into, the hopper.

In a related aspect, it should be appreciated that an orientation of the axis of rotation of auger 104 need not be vertical, although the axis will generally not be horizontal. For certain applications, a diagonal orientation of the axis of auger 104 might be appropriate and even advantageous so long as feeding of filler material 16 into and through barrel 106 is achieved via the assistance of gravity. In some embodiments, filling of barriers may be facilitated through use of any suitable technique, for example, by use of pneumatic assistance or the use of a slinger conveyor, belt conveyor, or bucket conveyor to deliver the filler material to the auger.

Filing device 100 may include a tensioner 128 coupled to barrel 106 at or near dispensing end 126 to facilitate attaching tubing 12 thereto. Tensioner 128 may be rigidly coupled to gantry 105 or another support structure so as to allow tensioning on tubing 12 to be relatively precise. An adaptor 130 may be attached to barrel 106 at dispensing end 126 to accommodate tubing having a different diameter than the barrel. Tubing 12 may be formed of a flexible sock-like material of a type well-known in the art and capable of slipping over dispensing end 126 or adaptor 130 to receive filler material 16 from barrel 106. Some embodiments may have a coating, such as a slip coating, on the barrel to allow for more efficient addition or removal of the tubing, or may have a custom fitted barrel opening. Still other embodiments may contain a mechanism such as a potentiometer or the like configured to monitor the rate at which the tubing is being filled and/or pulled away from the barrel while filling for securing the tubing to the barrel and/or for releasing filled barriers once filling is complete.

Assembly 10 is structured such that barriers 14 can be coiled as tubing 12 is being loaded with the filler material. It has been discovered that coiling barriers contemporaneously with filling may be more efficient than other coiling strategies, and may reduce stresses on the tubing material commonly associated with coiling of filled barriers, which may compromise the material's integrity. Contemporaneous coiling may be accomplished by movement of barrel 106 and receiving device 200 relative to each other in a coiling pattern. For instance, gantry 105 may include a first orbital mount 132 facilitating movement of hopper 102 along an X-axis 134 of gantry 105, and a second orbital mount 136 facilitating movement of hopper 102 along a Y-axis 138 of gantry 105, with each the mounts having the form of a trolley. Mounts 132, 136 may facilitate orbital movement of hopper 102 and/or barrel 106 on a horizontal plane such that hopper 102 and/or barrel 106 can be moved in a coiling pattern, for example, barrel 106 may be moved in a generally orbital path relative to a vertical axis extending through a coiling surface 201 of receiving device 200 as desired during filling. Coiling surface 201 may include a pallet (hereinafter "pallet 201"), for instance. Hopper 102 and/or barrel 106 may be moved manually by an operator physically pushing and/or pulling filling device 100 along X- and Y-axes 134, 138 in a coiling pattern. Other embodiments may include different and/or additional structures or mechanisms, such as a parallelogram swing arm, to allow the hopper and/or barrel to be moved in a coiling pattern. In some embodiments, the filling device may include ball screw drives with servomotors or analogous structures that may allow for remote or automated movement of the hopper and/or the barrel along the X- and Y-axes through use of computer numerical control (CNC), a vertical float or other mechanism actuated by filling of a previous barrier, or any other means. In such embodiments, movement about the X- and Y-axes may be accomplished by a control mechanism structured to cause movement of the filling device during operation. In other embodiments, coiling of the barriers may be accomplished by movement of the receiving device or a component of the receiving device, such as the pallet, for example, relative to the barrel and/or the filling device. Such embodiments may allow the filling device and/or the barrel to remain stationary to provide a fixed target for delivery of the filler material from the material conveyor to the hopper. In still other embodiments, coiling may be accomplished by any other mechanical configuration that allows for orbital movement of the barrel and/or the filling device in a substantially circular pattern or other coiling pattern relative to the receiving device, or vice versa. For instance, a relatively long barrel having a flexible distal portion could be used, wherein the distal portion may extend beyond a distal end of the auger. In such an embodiment, the long and flexible distal portion of the barrel could be manipulated to vary a discharge location of filled barriers and then enable an operator to manually or autonomously control the location of the barrier relative to the pallet as desired during filling. Certain embodiments of the present disclosure may include an extended gantry capable of supporting multiple hoppers, or multiple, interchangeable barrels. Extended gantries installed in a location with additional space might allow gantry to move components of the assembly out of the way when necessary, thereby facilitating the changeover between pallets.

Figure 3:
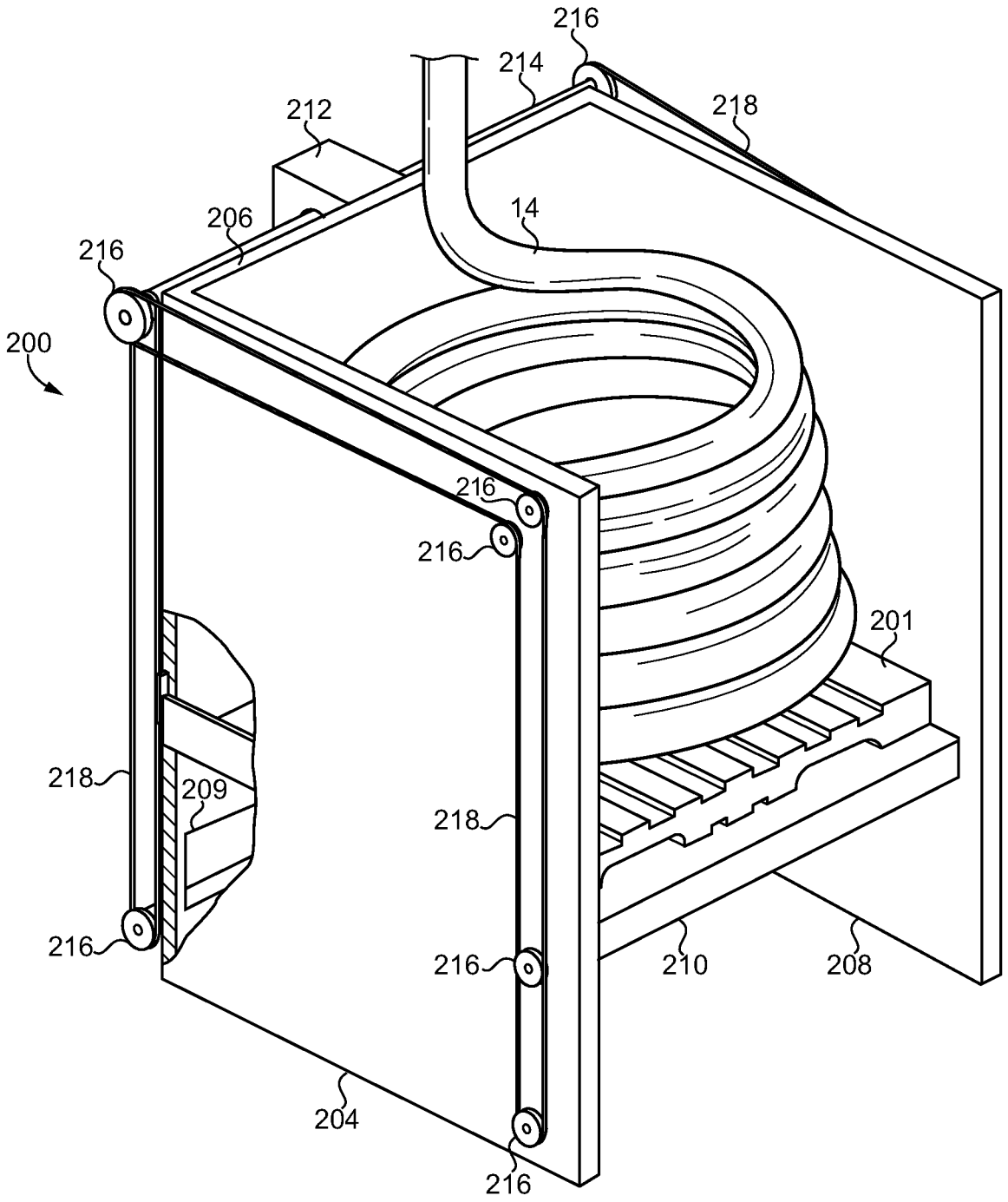
FIG. 3 is a partially sectioned diagrammatic view of a barrier receiving device, according to one embodiment.

Referring now also to FIG. 3, a perspective view of receiving device 200 is shown. Receiving device 200 may be substantially box-shaped, with one or more open surfaces, though alternative embodiments having a variety of different shapes and configurations are also contemplated. Receiving device 200 may include a first wall 204, a second wall 206, and a third wall 208, each of which may be vertically oriented and positioned in a generally U-shaped configuration. Put differently, first wall 204 and third wall 208 may be substantially parallel, with second wall 206 disposed there between. Second wall 206 may include a pallet slot 209 for inserting an empty pallet into receiving device 200 as will be discussed further hereinafter. Receiving device 200 further includes a horizontally-oriented movable floor 210 positioned in a U-shaped opening formed by walls 204, 206, 208. Some embodiments may also include a door positioned on an open side of the receiving device 200 configured to be closed during filling and that may be manually or automatically opened when removing the completed pallet.

Movable floor 210 may be movably coupled with receiving device 200 so as to be vertically adjustable for receive filled barriers 14. In a practical implementation of assembly 10, movable floor 210 may be positioned in receiving device 200 near dispensing end 126 with pallet 201 positioned thereon to receive filled barriers 14. Movement of filling device 100 about X-axis 134 and Y-axis 138 allows barrier 14 to be coiled as tubing 12 is being filled, meaning the barrier is coiled such that a first coil layer is completed before beginning a second coil layer on top of and in register of the first coil layer. This process may be repeated until layers of the coiled barrier reaches the desired number of layers. In alternative embodiments, different coiling methods may be used, such as spool coiling in which the barrier is coiled vertically in a first column to a desirable height, then a second column is coiled around the first column until the desirable height, then a third column is coiled around the second column as so on until the coil is completed.

Movable floor 210 of FIGS. 1-3 may be raised and/or lowered by a chain-driven mechanism. A box motor 212 having a rotation bar 214 may be attached to second wall 206 to energize the mechanism. A plurality of box gears 236 may be attached to each of rotation bar 214, walls 204, 208, and/or movable floor 210, with each box gear 236 being coupled with at least one other box gear 236 by a chain 218. Energization of box motor 212 may cause rotation bar 214 to rotate around an axis of rotation that may run substantially parallel to movable floor 210. Rotational motion of rotation bar 214 may be translated to vertical motion by movable floor 210 through one or more chains 218 and box gears 236 coupled therewith as will be understood by those of skill in the art. For example, rotation of rotation bar 214 in a counterclockwise direction may cause movable floor 210 to ascend in receiving device 200 towards barrel 106, while rotation of rotation bar 214 in a clockwise direction may cause movable floor 210 to descend in receiving device 200 towards the ground. In other embodiments, movable floor 210 may be supported by a spring having a tension adjusted to depress at a rate reflective of the weight and height of each coiling layer (i.e., weight of one coiling layer causes spring to depress the amount necessary to accommodate a new coiling layer). In still other embodiments, movable floor 210 may be adjusted manually, may be supported by hydraulic actuators that can be adjusted, may be assisted with a counter weight, or may be adjusted by any other mechanism that would be contemplated those of skill in the art.

Assembly 10 may be configured such that movable floor 210 is lowered at a rate that is based on the rate at which barrier 14 is being coiled. Put differently, the rate at which movable floor 210 may be configured such that once a first coiling layer is completed, movable floor 210 lowers enough to allow for a second coiling layer. Once the second coiling layer is completed, movable floor 210 lowers enough to allow for a third coiling layer and so on. In other embodiments, the rate at which movable floor 210 is lowered may be a predefined rate configured to match an expected barrier fill rate. In still other embodiments, the rate may be responsive to an operating parameter indicative of the progression of filling the tubing, such as the volume of the filler material processed by the auger, the weight of the barriers coiled on the pallet, or the rate at which the filler material is being delivered to the tubing. In still other embodiments, the rate may be responsive to a float sensor or device to detect when the floor should adjust. As the coil progresses from one level to the next a float or sensor upstream of the barrel will detect the level change and drop the floor.

In a practical implementation strategy, assembly 10 may be incorporated into a system for filling and coiling barrier tubing (hereinafter "system") 300. Referring now to FIG. 4, system 300 is shown according to one embodiment. System 300 may include a storage hopper 302, an assembly 310, and a processing station 318. Assembly 310 may be identical to assembly 10, and may include a filing device 312 and a receiving device 314, each of which may be identical to filing device 100 and receiving device 200, respectively. System 300 may also include one or more conveyors, each of which is associated with storage hopper 302, assembly 310, and/or processing station 318 to facilitate process flow will be discussed hereinafter.

Storage hopper 302 may be a surge hopper or any other type of hopper or container capable of receiving large quantities of material and administering that material in metered quantities. Storage hopper 302 may include a discharge outlet 304 for releasing filler material 106 to a material conveyor 308. Material conveyor 308 may be a slinger conveyor, a belt conveyor, a bucket conveyor, or any other type of conveyor suitable for transporting filler material 16 to assembly 310. In other embodiments, the filler material may be transported to the assembly by any other suitable means, such as pneumatic flow, for instance. A metering hatch 306 may be movably coupled to storage hopper 302 at discharge outlet 304 to release metered quantities of filler material 16. In some embodiments, the metering hatch may be remotely or automatically actuated in accordance with the present disclosure. For example, the assembly may include a sensor configured to detect instances in which a level or quantity of the filler material in a coiler hopper of the filing device falls below a predefined threshold and produce data indicative thereof. Further, the system may include a controller configured to generate a signal responsive the data, the signal structured to cause the metering hatch to release an amount of the filler material calculated to raise the level or quantity of the filler material in the coiler hopper to or above the predefined threshold. In still other embodiments, the metering hatch may be remotely controlled to allow an operator to remotely release an amount of the filler material responsive to an alert or warning indicative of low filler material.

System 300 may include manual and/or automatic throttle controls for controlling the speed at which filler material 16 is delivered to the coiler hopper and for controlling the speed of an auger in filling device 312, which may therefore allow for control of the rate at which tubing 12 is filled. As tubing 12 is filled with filler material 16, one or more components of filling device 312, such as a barrel or the coiler hopper, may be moved along an X-axis and/or a Y-axis of the filling device according to the present disclosure to allow for coiling of filled barriers 14 on a pallet, which may be positioned in receiving device 314. In some embodiments, assembly 310 may allow for coiling through alternative means, for example an extended material conduit may be, for example, a pneumatic filling device coupled with the storage hopper, wherein the assembly may not be supported by a gantry and wherein the material conduit may be moved in a coiling pattern by any suitable means. The pallet may be positioned on a movable floor in receiving device 314, which may be vertically configured responsive to an operating parameter as discussed herein. Some embodiments may include a fixed position floor and/or may include a barrel and/or hopper capable of being vertically adjusted relative to the floor. In such embodiments, the barrel and/or the hopper may be moved vertically relative to the floor during filling. When the filled barriers have been coiled on the pallet to a desirable height, the auger may discontinue pushing filler material 16, at which point tubing may be removed from the barrel and the open end of barrier 14 may be sealed by stapling, tying a knot or any other means.

Upon completion of filling and coiling, tubing 12 and/or barrier 14 may be removed from the barrel by any suitable means, whether manually, automatically, remotely, or otherwise, such as by pushing the coiled barrier out of the assembly through use of an actuatable cylinder mechanism, or use of a roller or chain conveyor to otherwise urge the completed pallet out of the assembly. Completed coiling pallets may be ejected from assembly 10 by pushing an empty pallet into assembly 310 through a pallet slot in receiving device 314. In doing so, the empty pallet may come into contact with and urge the completed coiling pallet out of assembly 310 and onto buffer conveyor 316. Buffer conveyor 314 may be, for example, a chute conveyor, a wheel conveyor, a roller conveyor, a chain conveyor, or any other type of suitable conveyor, or may be a different structure capable of holding completed pallets for further processing. In other embodiments, no further processing may be needed and ejected pallets may be stored on site or transported to a remote location for storage, sale, or use. In the process of urging the completed pallet out of assembly 310, the empty pallet may replace the completed pallet on the movable floor. In this way, system 300 may be primed to begin the process of filling and coiling a new length of tubing 12, though system 300 may also discontinue processing barriers once assembly 310 has produced the completed pallet. In some embodiments, completed pallets may be removed from the assembly by other means. For example, by use of a crane, forklift, or the like, or by any other automated, remote, or other mechanism or process. Still other embodiments still might include features that may allow multiple barriers to be filled without the need to pause production to load a new barrier tube or sleeve of tubing. For example, the assembly may include multiple, unfilled rolls of tubing positioned about the barrel, or the system might include a pallet storage rack or other device with an auto destacking feature, a feeding mechanism, or the like to supply empty pallets to the assembly.

From buffer conveyor 316, completed pallets may pass to a processing station 318 to be packaged for shipment, storage, or any other purpose. Processing station 318 may be a plastic wrapping device such as a stretch wrapper or a shrink wrapper structured to wrap completed pallets with a plastic material. In some embodiments, processing station 318 may be structured to process completed pallets by any other means as necessary and/or otherwise suitable for transport and/or storage. In still other embodiments, the system may include multiple processing stations configured for production line processing, custom processing, or any other type of processing that may be desired. Upon exiting processing station 318, completed pallets may pass to an accumulation conveyor 320 to be held for shipment or transportation to a worksite, storage area, or other location.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. It will be appreciated that certain features and/or properties of the present disclosure, such as relative dimensions or angles, may not be shown to scale. As noted above, the teachings set forth herein are applicable to a variety of different devices, assemblies, and systems having a variety of different structures than those specifically described herein. Other aspects, features and advantages will be apparent upon an examination of the attached drawings and appended claims. As used herein, the articles "a" and "an" are intended to include one or more items, and may be used interchangeably with "at least one." Where only one item is intended, the term "one" or similar language is used. Also, as used herein, the terms "has," "have," "having," or the like are intended to be open-ended terms.

What is claimed is:

1. A barrier tube filling assembly comprising:

a suspension element;

a coiling surface having a vertical axis; and a material conduit for feeding a material into a barrier tube attached to the material conduit, and including a feeder section having a dispensing end, and the dispensing end having a dispensing end center axis;

the material conduit being coupled with the suspension element such that the feeder section is suspended above the coiling surface in a vertical orientation;

at least one of the dispensing end or the coiling surface is movable along a horizontal X-axis and along a horizontal Y-axis; and the dispensing end center axis is movable in an orbital path relative to the vertical axis, based upon movement of the at least one of the dispensing end or the coiling surface along the horizontal X-axis and along the horizontal Y-axis.

2. The assembly of claim 1 further including an auger having a cylindrical shaft and a fighting, the auger being at least partially disposed within the feeder section such that the auger can rotate in the material conduit around an axis of rotation at least partially defined by the cylindrical shaft, and the auger being oriented such that the flighting is positioned below the cylindrical shaft.

3. The assembly of claim 2 wherein the flighting has an axial length not greater than one-third of an axial length of the feeder section.

4. The assembly of claim 2 further including a beater bar on the cylindrical shaft, the beater bar sized and shaped to facilitate feeding of the material through the material conduit towards the dispensing end.

5. The assembly of claim 1 wherein the suspension element is a gantry, the assembly further including an orbital mount coupling the material conduit with the gantry, and wherein the orbital mount is structured to allow the material conduit to move laterally on the gantry in the orbital path.

6. The assembly of claim 5 wherein the orbital mount is a first orbital mount and the assembly further includes a second orbital mount, the first orbital mount structured to allow the material conduit to move along the horizontal X-axis and the second orbital mount structured to allow the material conduit to move along the horizontal Y-axis.

7. The assembly of claim 1 further including a receiving device having a vertically adjustable floor structured to support the coiling surface.

8. The assembly of claim 7 further including a sensor structured to monitor an operational parameter indicative of progress in filling of empty barrier tubing, wherein the vertically adjustable floor is configured to descend in the receiving device responsive to the operating parameter.

9. A system for filling and processing barrier tubes comprising:

a storage hopper;

a vertically oriented barrier tube filling assembly structured to fill an empty barrier tube with a filler material and coil the filled barrier tube;

a material conveyor coupling the storage hopper to the barrier tube filling assembly; and a processing station structured to receive a completed pallet of the coiled and filled barrier tube for packaging;

the barrier tube filling assembly further includes a suspension element, a coiling surface, and a material conduit, including a dispensing end, suspended by the suspension element above the coiling surface;

the coiling surface defines a vertical axis, and the dispensing end defines a dispensing end center axis; and at least one of the material conduit or the coiling surface is movable, such that the dispensing end center axis is movable in an orbital path around the vertical axis to coil a filled barrier tube upon the coiling surface.

10. The system of claim 9 wherein the barrier tube filling assembly further includes a receiving device having a vertically positionable floor structured to support the coiling surface, the vertically positionable floor structured to descend in the receiving device responsive to an operating parameter of the system.

11. The system of claim 9 further including a buffer conveyor coupling the barrier tube filling assembly with the processing station, the buffer conveyor structured to facilitate movement of the coiled barrier from the barrier tube filling assembly to the processing station.

12. The system of claim 9 wherein the processing station is a plastic wrapping device.

13. The system of claim 9 further including an accumulation conveyor structured to receive the completed pallet of the coiled and filled barrier tube from the processing station.

14. The system of claim 9 further including a controller configured to receive data indicative of an operating parameter of the system and generate a signal responsive thereto.

15. The system of claim 14 wherein the signal is structured to cause the storage hopper to release an amount of the filler material.

16. The system of claim 9 further including a pallet feeder proximal to the barrier tube filling assembly and including a feeding mechanism structured to push a coiling surface into the receiving device.

17. A barrier tube filling assembly comprising:

a suspension element;

a coiling surface having a vertical axis;

a material conduit that includes a feeder section at a dispensing end of the material conduit, the material conduit being coupled with the suspension element such that the feeder section is suspended above the coiling surface in a vertical orientation, and the dispensing end being movable in an orbital path relative to the vertical axis;

an auger having a cylindrical shaft and a flighting, the auger being at least partially disposed within the feeder section such that the auger can rotate in the material conduit around an axis of rotation at least partially defined by the cylindrical shaft, and the auger being oriented such that the fighting is positioned below the cylindrical shaft; and a beater bar on the cylindrical shaft, the beater bar sized and shaped to facilitate feeding of a filler material through the material conduit towards the dispensing end.

* * * * *